US012618192B2

(12) United States Patent
Amâncio Louro

(10) Patent No.: US 12,618,192 B2
(45) Date of Patent: May 5, 2026

(54) GARMENT IRONING SYSTEM

(71) Applicant: Diogo André Amâncio Louro, Queluz (PT)

(72) Inventor: Diogo André Amâncio Louro, Queluz (PT)

( * ) Notice: Subject to any disclaimer, the term of this patent is extended or adjusted under 35 U.S.C. 154(b) by 192 days.

(21) Appl. No.: 18/292,011

(22) PCT Filed: Aug. 3, 2022

(86) PCT No.: PCT/IB2022/057212

§ 371 (c)(1),
(2) Date: Jan. 25, 2024

(87) PCT Pub. No.: WO2023/012693

PCT Pub. Date: Feb. 9, 2023

(65) Prior Publication Data

US 2025/0066989 A1 Feb. 27, 2025

(30) Foreign Application Priority Data

Aug. 4, 2021 (PT) ..... 117384

(51) Int. Cl.
*D06F 73/02* (2006.01)
*D06F 95/00* (2006.01)

(52) U.S. Cl.
CPC ..... *D06F 73/02* (2013.01); *D06F 95/00* (2013.01)

(58) Field of Classification Search
CPC ..... D06F 73/02; D06F 95/00; D06F 59/02
See application file for complete search history.

(56) References Cited

U.S. PATENT DOCUMENTS

| | | | | |
|---|---|---|---|---|
| 2012/0000945 | A1 | 1/2012 | Cartabbia | |
| 2019/0024300 | A1* | 1/2019 | Tate | D06F 73/02 |
| 2021/0062399 | A1* | 3/2021 | Li | D06F 39/14 |
| 2023/0146409 | A1* | 5/2023 | Erturk | D06F 73/02 38/102 |
| 2024/0240386 | A1* | 7/2024 | Thielen | D06F 95/00 |

FOREIGN PATENT DOCUMENTS

| | | | |
|---|---|---|---|
| CN | 207760570 U | | 8/2018 |
| CN | 213447735 U | * | 6/2021 |
| DE | 102008020352 | | 10/2009 |

OTHER PUBLICATIONS

International Search Report for PCT/IB2022/057212 Mailed On Nov. 18, 2022.

* cited by examiner

*Primary Examiner* — Uyen T Nguyen
(74) *Attorney, Agent, or Firm* — Rivka Friedman

(57) ABSTRACT

It is an object of the present invention a garment ironing system. Said system comprises a control unit (1) configured to operate in coordination: an operating unit (2), defining an operation space adapted to receive at least one garment and programmed to perform an ironing task; and a transport unit (3) designed to convey the garment from a position outside the operation space to the interior of the operation space, where the ironing task will be performed.

17 Claims, 6 Drawing Sheets

GARMENT IRONING SYSTEM

FIELD OF THE INVENTION

The present invention falls within the field of ironing systems, in particular systems providing automated ironing of garments.

BACKGROUND OF THE INVENTION

Automatic ironing systems, which provide the task of ironing garments while minimizing human intervention, are already known to the state of the art.

In general terms, the operation of these systems is based on the application of a hot gas to the garment, which will be responsible for the ironing task. However, the application of this concept can be carried out according to two different operating principles: one in which the hot gas is applied directly to the garment, as is the case with the state-of-the-art ironing machines developed by the companies Effie and Folidmate; or, alternatively, using an inflation mechanism to cause an expansion of the inner volume of the garment, making its outer surface smooth and in a condition suitable for the application of hot gas. Systems which follow this operating principle are described for example in patent applications U.S. Pat. No. 5,732,859, EP1448834 or CN203295866.

However, regardless of the operating principle of the state-of-the-art systems, it has been observed that there are still significant limitations which impair the efficiency of the ironing task or require human intervention at an essential level to ensure the correct functioning of the system, in tasks such as, for example, preparing the garment before ironing.

All this creates disadvantages for the users of this type of system who either have no guarantee that the ironing task will be properly carried out or, in order to achieve this, must interact with the system in tasks that in some cases can be difficult and time-consuming.

The present solution addresses these disadvantages by providing a new, fully automated ironing system, aimed at guaranteeing the efficiency of the ironing task without the need for the user to act.

SUMMARY OF THE INVENTION

The object of the present invention is therefore a system for ironing garments. This solution thus provides that at least one garment can be ironed, effectively and without the need for user intervention, through a combination of mechanisms that interact in a synchronized manner.

Specifically, the proposed ironing system comprises (i) a control unit that is configured to operate, coordinately: (ii) an operating unit, defining an operation space adapted to receive at least one garment, and where the ironing task will be performed; and (iii) a transport unit configured to move the garment from a position outside the operation space to a position inside the operation space, and to move said garment within the operation space, once the ironing task is completed.

In an alternative embodiment of the system of the invention, said system additionally comprises (iv) a positioning unit, which is configured to actuate the garment so as to ensure that the latter is in the appropriate position for the ironing task to be performed.

Also, an object of the present invention is the method of operation of the ironing system.

1—control unit;
2—operating unit;
3—transport unit.

Figure 1:
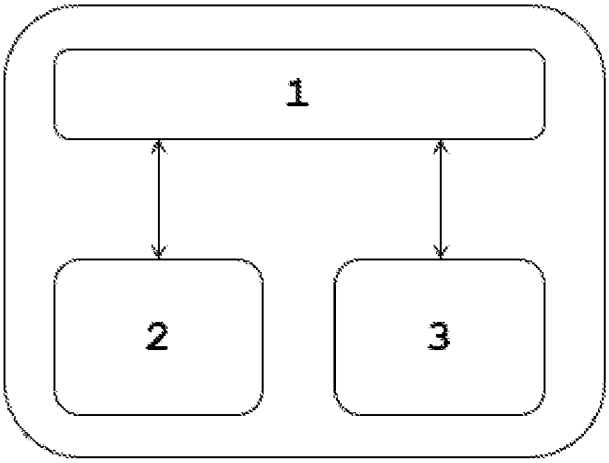
FIG. 1—block diagram illustration of the constituent units of a preferred embodiment of the system of the invention. The numerical reference signs represent.
Figure 2:
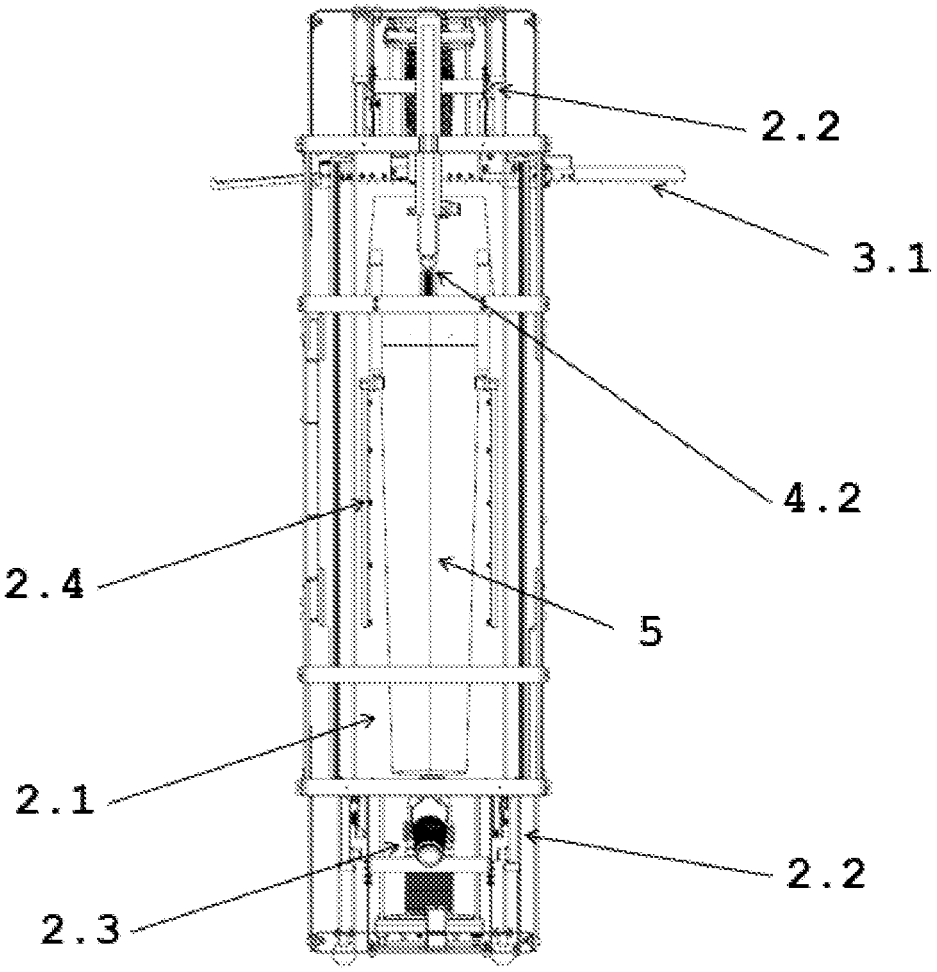

FIG. 2—side view of an embodiment of the system of the invention, where a garment is illustrated in a rest position inside the operation space. The numerical reference signs represent:

2.1—operation space;
2.2—means of operation;
2.3—inflation module;
2.4—gas injector module;
3.1—mechanical support
4.2—mechanical grippers;
5—garment.

Figure 3:
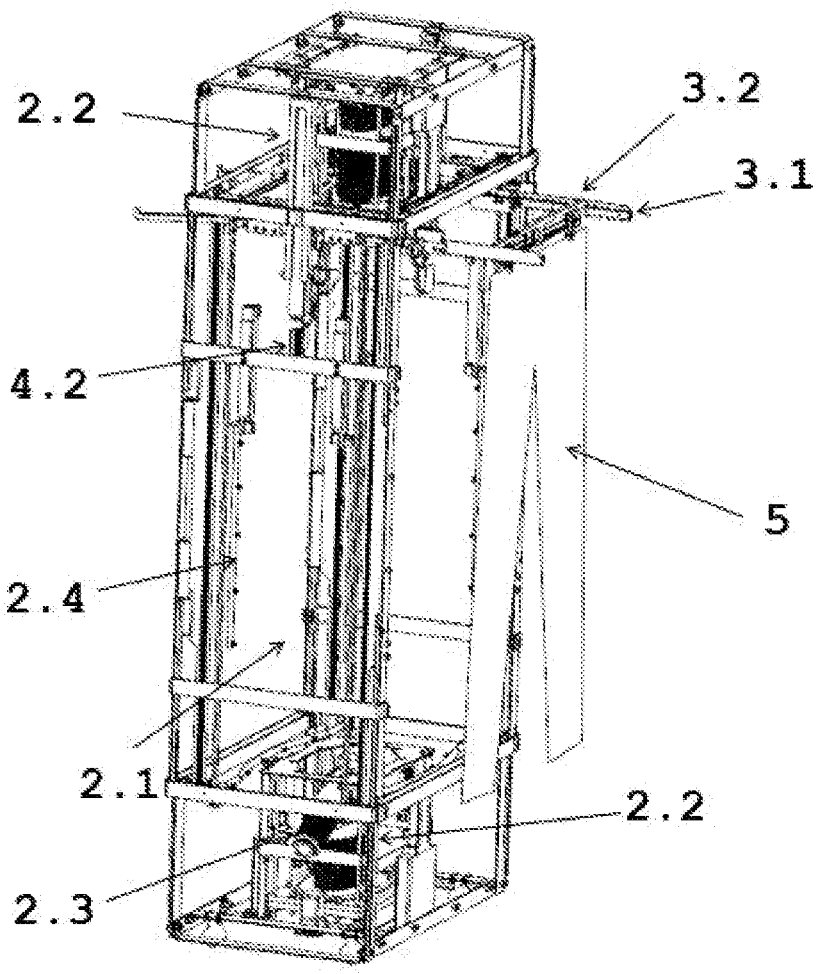

FIG. 3—perspective view of an embodiment of the system of the invention, illustrating the garment in a position outside the operation space. The numerical reference signs represent:

2.1—operation space;
2.2—means of operation;
2.3—inflation module;
2.4—gas injector module;
3.1—mechanical support;
3.2—hanger-type gripping element;
4.2—mechanical grippers;
5—garment.

Figure 4:
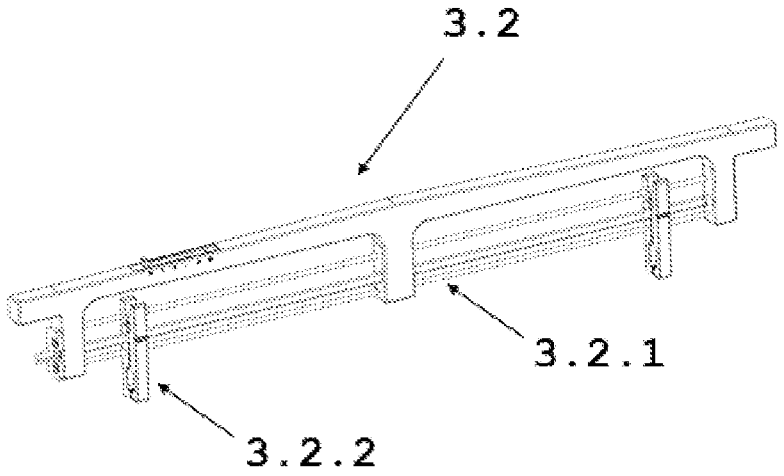

FIG. 4—illustration of an embodiment of the system of the invention, where the gripping element of the transport unit is a hanger. The numerical reference signs represent:

3.2—hanger;
3.2.1—drive shaft;
3.2.2—spring.

Figure 5:
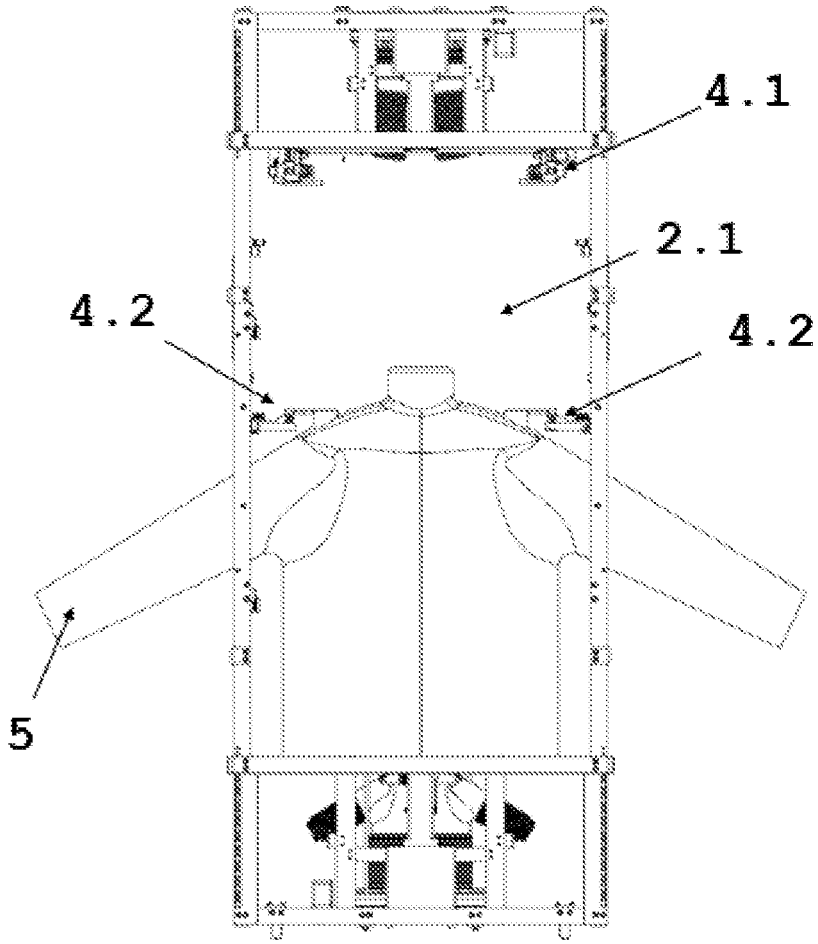

FIG. 5—illustration of an embodiment of the system of the invention, depicting the garment in an operational position, inside the operation space. The numerical reference signs represent:

2.1—operation space;
4.1—means of actuation;
4.2—mechanical grippers;
5—garment.

Figure 6:
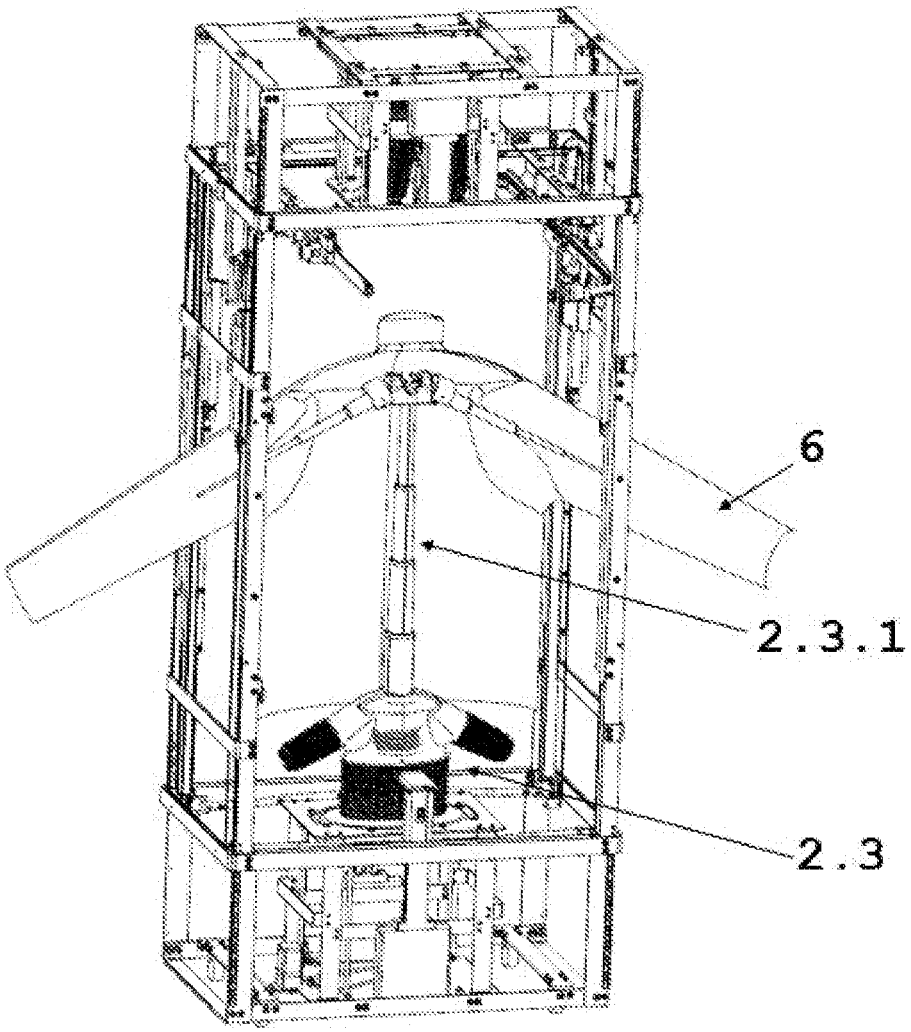

FIG. 6—illustration of an embodiment of the system of the invention, depicting the actuation mechanism of the inflation module of the operating unit. The numerical reference signs represent:

2.3—inflation module;
2.3.1—actuation mechanism;
6—ironing element.

Figure 7:
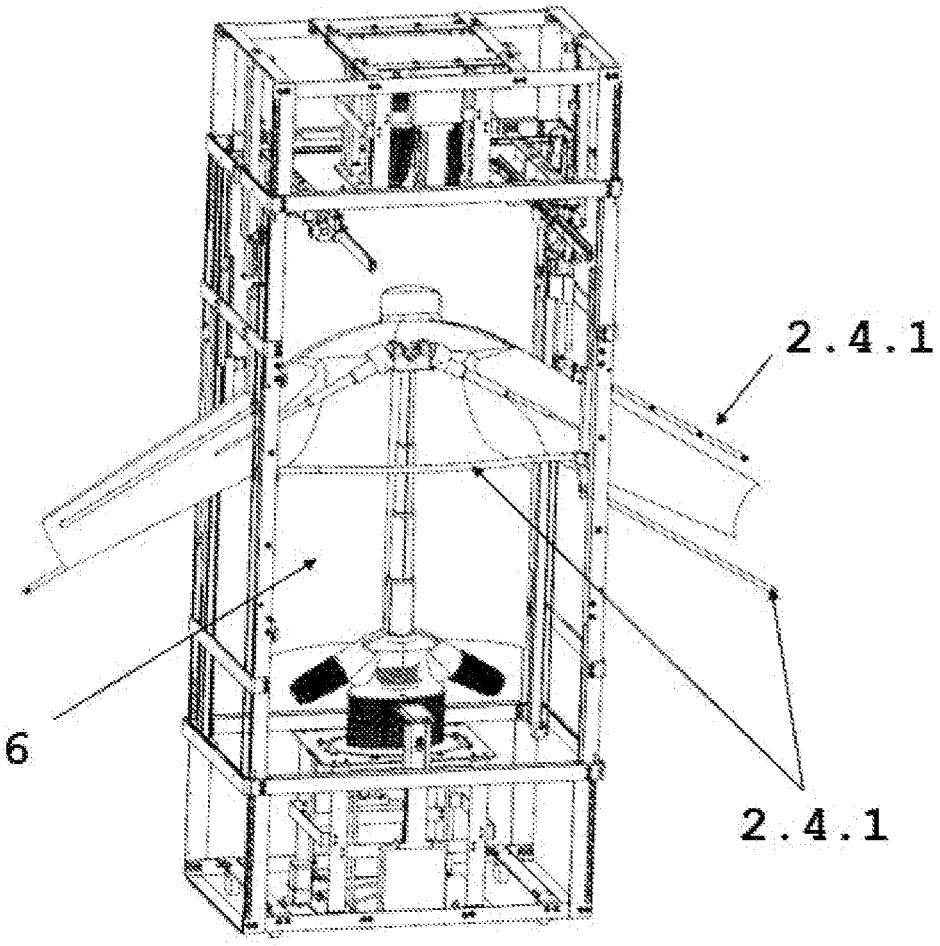

FIG. 7—illustration of an embodiment of the system of the invention, depicting the gas injector module, in particular the injector arms mechanism, used to inject gas adapted to ironing a surface of the ironing element. The numerical reference signs represent:

2.4.1—injector arms;
6—ironing element.

DETAILED DESCRIPTION OF THE INVENTION

The present invention relates to a system for ironing garments.

In generic terms, the system of the invention comprises a control unit (1), an operating unit (2) and a transport unit (3).

Additionally, and in a preferred embodiment of the system of the invention, it comprises a positioning unit (4).

The control unit (1) comprises computational requirements adapted to execute programmed computational routines for controlling all the other units that are part of the system, in a synchronous and coordinated manner, according to the execution of the programmed ironing task.

The operating unit (2) defines the operation space (2.1) of the system, which is adapted to receive at least one garment (5). In an embodiment of the system, the operating unit (2) may acquire the form of an enclosed mechanical structure. Specifically, and for the purposes of the present invention, the operating unit (2) comprises means of operation (2.2) configured for, in an operational position, actuating the garment (5) so as to allow an inflatable body to be inserted into the inner space of said garment (5). Additionally, the operating unit (2) comprises at least one inflation module (2.3) comprising, in turn, an inflatable body; the garment (5) and the inflatable body inside it defining the ironing element (6). Furthermore, the operating unit (2) also comprises at least one gas injector module (2.4), which is configured to inject gas adapted to ironing a surface of the ironing element (6). This ensures that the garment (5) is correctly positioned within the operation space (2.1) to receive the inflatable body and subsequently the gas responsible for the ironing task. These preparations are carried out automatically by the system without the user's intervention.

The transport unit (3) of the system comprises mechanical means configured to transport the garment (5) from a position in a space outside the operation space (2.1) to a position inside the operation space (2.1), so that the ironing task can be performed. Subsequently, and after the ironing task is completed, the mechanical means of the transport unit (3) act in such a way as to transport the garment (5) from a position inside the operation space (2.1) to a position outside the operation space (2.1).

In a preferred embodiment of the system of the invention, it additionally comprises a positioning unit (4). Said positioning unit (4) comprises mechanical means configured to vary the position of the garment (5) in the operation space (2.1), between the operational position, in which the ironing task is to be performed, and a rest position and vice versa. The rest position is defined as a position within the operation space (2.1), wherein the garment (5) is temporarily located until it is conveyed to the operational position by the operating unit (4) or to a position outside the operation space (2.1) by the transport unit (3). Additionally, the transport unit (3) may also convey a garment (5) from a position outside the operation space (2.1) to the rest position inside the operation space (2.1).

In another embodiment of the system of the invention, the transport unit (3) comprises the following elements: at least one mechanical support (3.1) and at least one gripping element (3.2). Said gripping element (3.2) is installed on the mechanical support (3.1) and is adapted to grip the garment (5). In particular, the transport unit (3) is configured to actuate a mechanical support (3.1) in such a way as to transport the gripping element (3.2)—and the garment (5) secured thereon—from a position in a space outside the operation space (2.1) to a rest position inside the operation space (2.1), and from the rest position inside the operation space (2.1), to a position outside the operation space (2.1). The system being designed in this way, with a functional relationship between all its units (2, 3, 4), makes it unnecessary for the user to act for intermediate tasks, such as inserting the garment (5) into the inflatable body or a supporting structure, whereby in the present case the user is only required to insert the gripping element (3.2), which holds the garment (5) to be ironed, into at least one mechanical support (3.1) of the transport unit (3). All of the following actions of the system, culminating in the execution of the ironing task, will be commanded by the control unit (1) through the synchronized actuation of the other units (2, 3, 4) of the system.

In another embodiment of the system, the mechanical means of the positioning unit (4) comprise actuation means (4.1) and adhesion means (4.2). In particular, the actuation means (4.1) are configured to release and secure the garment (5) on the gripping element (3.2) of the transport unit (3), and the adhesion means (4.2) are adapted to vary the position of the garment (5) in the operation space (2.1), between the operational position and the rest position, and vice versa. The adhesion means (4.2) may be implemented by a plurality of mechanical grippers and/or by at least one suction element. In particular, the suction element may be a suction nozzle.

In another embodiment of the system, the at least one mechanical support (3.1) of the transport unit (3) comprises two mechanical projections parallel to each other, each of said projections having at least one side face with engaging means adapted for installing the gripping element (3.2) between said parallel projections.

In another embodiment of the system, the gripping element (3.2) is a hanger. Particularly, the hanger (3.2) comprises at least a first longitudinal shaft, along which at least one spring (3.2.2) is installed; and a second longitudinal shaft (3.2.1), configured to cause displacement between a first spring leg and a second spring leg, when a rotational movement is applied by the actuating means (4.1) of the positioning unit (4). In particular, the rotational movement in a first direction, applied by the actuation means (4.2) to the second longitudinal shaft (3.2.1), causes a displacement between the first spring leg and the second spring leg, promoting release of the garment (5); and the rotational movement in a second direction, opposite to the first direction, applied by the actuation means (4.2) to the second longitudinal shaft (3.2.1), causes the first spring leg and the second spring leg to come together, such that the garment (5) is held by the spring (3.2.2). As a result of the operation of the shafts and due to the configuration of their direction of rotation, a garment (5) can be automatically held by or released from the hanger (3.2) without human intervention.

In another embodiment of the system, the positioning unit (4) comprises fastening elements, configured to keep the gripping element (3.2) in the rest position, inside the operation space (2.1). The action of said fastening elements ensures the stability of the gripping element (3.2) during the action of the actuating means (4.1) of the positioning unit (4) to release or secure the garment (5). The action of the fastening elements is of particular importance when the gripping element (3.2) is of hanger type, since they provide the stability of the hanger during actuation of its second longitudinal shaft (3.2.1) by the actuating means (4.1). This ensures that the hanger remains correctly positioned during both the release and the attachment actions of the garment (5) on the hanger (3.2). In another embodiment of the system, the inflatable body of the inflation module (2.3) of the operating unit (2) is made by means of a mixture of materials comprising silicone and/or rubber.

In another embodiment of the system, the shape of the inflatable body is adapted to fill the entire inner space of the garment (5).

In another embodiment of the system, the inflation module (2.3) of the operating unit (2) comprises an actuation mechanism (2.3.1) adapted to adjust the inflatable body to the space inside the garment (5). Therefore, using this mechanism (2.3.1) it is guaranteed that the inflatable body is correctly positioned inside the garment (5), being adapted to the different shapes it may have when filling its inner space, without the need for user intervention. In an alternative embodiment, the actuation mechanism (2.3.1) a pneumatic mechanism, implemented by pneumatic cylinders. Alternatively, the actuation mechanism (2.3.1) is a hydraulic mechanism implemented by hydraulic cylinders. Alternatively, the actuation mechanism (2.3.1) comprises at least one electric motor and at least one ruler module driven by at least one gear wheel, which may be driven by at least one electric motor.

In another embodiment of the system, the operating unit (2) comprises two inflation modules (2.3). A first module in which the shape of the inflatable body is adapted to fill the entire inner space of a shirt-type garment, and a second inflation module in which the shape of the inflatable body is adapted to fill the entire inner space of a trouser-type garment. As a result of this structural configuration, the system is versatile and adaptable to the different garments (5) to be ironed.

In another embodiment of the system, the means of operation (2.2) of the operating unit (2) are implemented by mechanical grippers and/or at least one suction element. In particular, the suction element may be a suction nozzle.

In another embodiment of the system, each gas injector module (2.4) of the operating unit (2) comprises a hot gas generator. Said generator is configured to generate hot air in a temperature range from 50° C. to 300° C., the gas may be water vapour and/or hot air.

In another embodiment of the system, the gas injector module (2.4) additionally comprises a plurality of injector heads configured to inject gas along the surface of the ironing element (6).

In another embodiment of the system, the gas injector module (2.4) comprises a mechanical structure, enclosing the entire operation space (2.1), a plurality of injector arms (2.4.1), on the surface of which the plurality of injector heads are installed; and a network of gas ducts configured to route gas from the hot gas generator to the plurality of injector arms (2.4.1). With this configuration, it is guaranteed that the entire surface of the ironing element (6) receives the hot gas injected by the injector heads, since the use of injector arms (2.4.1) makes it possible to increase the operating range of the system, enabling, for example, garments (5) with different sizes to be effectively ironed. Even more particularly, the mechanical structure further comprises at least one rail mounted on its surface, to which at least one injector arm (2.4.1) is coupled, in order to move it along the mechanical structure.

In another embodiment of the system, the gas to be injected by the gas injector module (2.4) comprises at least one gaseous fragrance in addition to the gas used for ironing the ironing element (6). In this way, the mixture that is injected by the gas injector module (2.4) makes it possible, in addition to the ironing task, to provide the ironing element (6) with a scent that is pleasant to the user.

The present invention also relates to the method of operation of the ironing system. The method comprises the following steps:

i. conveying of the garment (5) from a position outside the operation space (2.1) to a position inside the operation space (2.1), by the transport unit (3);

ii. actuation of the means of operation (2.2) of the operating unit (2) in order to, in an operational position, actuate the garment (5) so as to allow insertion of an inflatable body into its inner space;

iii. insertion of the inflatable body of the inflation module (2.3) of the operating unit (2) into the inner space of the garment (5), defining the ironing element (6);

iv. injection of gas adapted to ironing a surface of the ironing element (6), by the gas injector module (2.4) of the operating unit (2).

In an embodiment of the aforementioned method, the step of transporting the garment (5) from a position outside the operation space (2.1) to a position inside the operation space (2.1) involves activation of at least one gripping element (3.2) installed on at least one mechanical support (3.1) of the transport unit (3).

In another embodiment of the method, it additionally comprises the step of positioning the garment (5) in an operational position within the operation space (2.1) by the positioning unit (4). This step being performed before the means of operation (2.2) of the operating unit (2) are actuated to drive the garment (5).

In another embodiment of the method, the step of positioning the garment (5) in an operational position within the operation space (2.1) involves actuating means (4.1) of the positioning unit (4) to release the garment (5) from the gripping element (3.2) of the transport unit (3).

In another embodiment of the method, it additionally comprises the following steps:

v. removing the inflatable body from the interior of the garment (5);

vi. actuating the adhesion means (4.2) of the positioning unit (4) so as to position the garment (5) in a rest position within the operation space (2.1);

vii. driving the actuation means (4.1) of the positioning unit (4) to secure the garment (5) to the gripping element (3.2);

viii. conveying of the garment (5) from the rest position inside the operation space (2.1) to a position outside the operation space (2.1) by the transport unit (3).

As will be evident to a person skilled in the art, the present invention should not be limited to the embodiments described herein, with a number of changes being possible, which remain within the scope of this invention. Of course, the preferred embodiments above described are combinable in the different possible forms, the repetition of all such combinations being herein avoided.

The invention claimed is:

1. A garment ironing system, comprising:

a control unit configured to operate an operating unit, a transport unit and a positioning unit;

the operating unit, defining an operation space adapted to receive, at least, one garment and comprising:

at least one inflation module comprising an inflatable body; the garment and the inflatable body therein defining an ironing element;

means of operation configured for, in an operational position within the operation space, actuating the garment so as to allow insertion of the inflatable body into an inner space of said garment; and at least one gas injector module configured to inject a gas suitable for ironing a surface of the ironing element;

the transport unit comprising mechanical means configured to convey the garment from a position in a space outside the operation space to a position inside the operation space, and from a position inside the operation space to a position in the space outside the operation space;

the positioning unit comprising mechanical means configured to vary the position of the garment within the operation space between the operational position and a rest position and vice versa;

and wherein, the mechanical means of the transport unit comprise:

at least one mechanical support and at least one gripping element installed on the mechanical support and adapted to grip the garment;

the transport unit being configured to actuate the at least one mechanical support such that the at least one mechanical support transports the at least one gripping element:

from a position outside the operation space to a rest position inside the operation space, and from the rest position inside the operation space to the position outside the operation space;

wherein the mechanical means of the positioning unit comprise:

actuation means and adhesion means;

wherein the actuation means are configured to release and secure the garment on the at least one gripping element of the transport unit, and the adhesion means are adapted to vary the position of the garment in the operation space, between the operational position and the rest position, and vice versa;

and wherein, the at least one mechanical support of the transport unit is comprised of two mechanical projections parallel to each other, each of said projections adapted for installing the at least one gripping element between said parallel projections; the at least one gripping element is a hanger.

2. The garment ironing system according to claim 1, wherein the hanger comprises at least a first longitudinal shaft, along which at least one spring is installed; and a second longitudinal shaft configured to cause displacement between a first spring leg and a second spring leg when a rotational movement is applied by the actuation means of the positioning unit;

and wherein, the rotational movement in a first direction, applied by the actuation means to the second longitudinal shaft, causes the first spring leg and the second spring leg to move apart, promoting release of the garment; and rotational movement in a second direction, opposite to the first direction, applied by the actuation means to the second longitudinal shaft, causes the first spring leg and the second spring leg to draw together, such that the garment is held by the at least one spring.

3. The garment ironing system according to claim 1, wherein the adhesion means are implemented by mechanical grippers and/or by at least one suction element.

4. The garment ironing system according to claim 1, wherein the inflatable body of the least one inflation module of the operating unit is made by means of a mixture of materials comprising silicone and/or rubber.

5. The garment ironing system according to claim 1, wherein a shape of the inflatable body is adapted to fill an entirety of the inner space of the garment.

6. The garment ironing system according to claim 1, wherein the least one inflation module of the operating unit comprises an actuation mechanism adapted to adjust the inflatable body to the inner space of the garment;

and wherein, said actuation mechanism is a pneumatic mechanism; said mechanism being implemented by pneumatic cylinders; or said actuation mechanism is a hydraulic mechanism; said mechanism being implemented by hydraulic cylinders;

and wherein, the actuation mechanism comprises at least one electric motor and at least one ruler module being driven by at least one gear wheel; the at least one gear wheel being driven by at least one electric motor.

7. The garment ironing system according to claim 1, wherein the operating unit comprises two inflatable modules, wherein:

a first inflatable module has a first inflatable body having a shape that is adapted to fill an entire inner space of a shirt-type garment; and a second inflation module has a second inflatable body having a shape that is adapted to fill an entire inner space of a trouser-type garment.

8. The garment ironing system according to claim 1, wherein the means of operation of the operating unit are implemented by mechanical grippers and/or by at least one suction element.

9. The garment ironing system according to claim 3, wherein the at least one suction element is a suction nozzle.

10. The garment ironing system according to claim 1, wherein the at least one gas injector module comprises a hot gas generator; said generator being configured to generate hot gas on a temperature range from 50° C. to 300° C.; said hot gas being water vapour and/or hot air.

11. The garment ironing system according to claim 1, wherein the at least one gas injector module additionally comprises a plurality of injector heads configured to inject gas along the surface of the ironing element.

12. The garment ironing system according to claim 10, wherein the at least one gas injector module comprises:

a mechanical structure, enclosing the entire operation space;

a plurality of injector arms, on a surface of which a plurality of injector heads is installed; and a network of gas ducts configured to route gas from the hot gas generator to the plurality of injector arms;

and wherein, the mechanical structure additionally comprises at least one rail installed on its surface; and wherein the at least one injector arm of the plurality of injector arms is coupled to the rail so as to move along the mechanical structure.

13. The garment ironing system according to claim 1, wherein the gas to be injected by the at least one gas injector module comprises at least one gaseous fragrance.

14. A method of operation of the ironing system of claim 1, comprising steps of:

i. conveying, by the transport unit, of the garment from a position outside the operation space to a position inside the operation space;

ii. actuation of the means of operation of the operating unit for, in an operational position, actuating the garment so as to allow the insertion of an inflatable body in its inner space;

iii. insertion of the inflatable body of the operating unit's inflation module into the inner space of the garment, defining the ironing element iv. injection of gas adapted to ironing a surface of the ironing element, through the at least one gas injector module of the operating unit.

15. The method of operation of the ironing system according to claim 14, wherein the step of conveying the garment from a position outside the operation space to a position inside the operation space involves actuation of at least one gripping element installed on at least one mechanical support of the transport unit;

and wherein, the method further comprising the step of positioning the garment in the operational position inside the operation space by the positioning unit; this step being performed prior to actuating the means of operation of the operating unit to actuate the garment.

16. The method of operation of the ironing system according to claim 15, wherein the step of positioning the garment in the operational position inside the operation space, involves driving the actuation means of the positioning unit to release the garment from the at least one gripping element of the transport unit.

17. The method of operation of the ironing system according to claim 15, further comprising the following steps:

removing the inflatable body from the inner space of the garment;

actuating the adhesion means of the positioning unit so as to position the garment in a rest position inside the operation space;

driving the means of actuation of the positioning unit in order to secure the garment to the at least one gripping element;

conveying of the garment from the rest position inside the operation space to a position outside the operation space, by the transport unit.

* * * * *